United States Patent [19]

Buckley et al.

[11] Patent Number: 4,921,254

[45] Date of Patent: May 1, 1990

[54] GOLFER'S TRAINING DEVICE AND METHOD

[76] Inventors: Gerald T. Buckley, 2545 Taraval St., San Francisco, Calif. 94116; Jamie N. Gonzalez, 2106 Folsom St., San Francisco, Calif. 94110

[21] Appl. No.: 293,735

[22] Filed: Jan. 5, 1989

[51] Int. Cl.[5] ..... A63B 69/36

[52] U.S. Cl. ..... 273/183 B; 273/192; 273/187 R

[58] Field of Search ..... 273/191 R, 191 A, 191 B, 273/192, 186 R, 186 C, 183 B, 188 R, 188 A, 187 R

[56] References Cited

U.S. PATENT DOCUMENTS

| | | | |
|---|---|---|---|
| 1,545,648 | 7/1925 | Fletcher | 273/192 |
| 3,232,623 | 2/1966 | Abrams et al. | 273/192 |
| 3,638,950 | 2/1972 | Hyollaine | 273/187 R |
| 3,806,133 | 4/1974 | Cork | 273/192 |
| 3,920,248 | 11/1975 | Medders | 273/186 C |
| 3,955,821 | 5/1976 | Spedding | 273/187 B |
| 4,023,811 | 5/1977 | Decota | 273/186 R |
| 4,082,287 | 4/1978 | Berkey | 273/186 C |
| 4,106,771 | 8/1978 | Fern | 273/183 B |
| 4,133,535 | 1/1979 | Marsh | 273/192 |
| 4,147,356 | 4/1979 | Brandell | 273/183 B |
| 4,315,626 | 2/1982 | Hamm | 273/186 C |
| 4,437,669 | 3/1984 | Pelz | 273/192 |
| 4,651,994 | 3/1987 | Lee | 273/187 B |

*Primary Examiner*—George J. Marlo

*Attorney, Agent, or Firm*—Townsend and Townsend

[57] ABSTRACT

An apparatus permits practicing golf swings and putting. The apparatus includes an elongated bar (6) that is pivotally attached at one end to a pivot mount (50) that rests upon the ground or other practice surface. In a preferred embodiment, depending upon the type of practice desired, a swing end piece (30) or a putting end piece (40) is removably attached to the second end of the elongated bar. When practicing swings, the swing end piece is attached, allowing the bar to rest horizontally across the golfer's shoe tips. If the backswing and downstroke are proper, the bar will remain across the shoe tips exerting a downward tactile force, coming off the right shoe tip only during the latter part of the downstroke and remaining off during the follow-through. In this manner, the apparatus provides guidance to the golfer during all phases of the golf swing. When practicing putting, the putting end piece is attached. The bar is aimed toward the target and the ball is placed beneath the bar, allowing the bar to be used to maintain proper eye contact with the ball. The height of the bar requires the golfer to use a low putting stroke. Proper putting occurs when the struck ball passes along an imaginary line extending through the putting end piece to the target.

23 Claims, 5 Drawing Sheets

GOLFER'S TRAINING DEVICE AND METHOD

BACKGROUND OF THE INVENTION

The invention relates to devices for golfers to improve their skill while practicing swinging and putting.

Golfers know that during a backswing, weight should be maintained on the inside of the golfer's right foot (it will be assumed that the golfer is right-handed). As the club comes down to strike the ball, rotation should be from the inside of the golfer's right foot, with transfer of weight to the lower left body side occurring before the ball has been struck. Proper balance (i.e., weight transfer during the swing). alignment with the ball and body stance during the backswing and follow-through are equally important. Generally, prior art golf practice devices have not recognized balance and weight shift as the most important factors during swinging. While devices exist that permit improvement of balance, alignment or stance, known devices do not provide for improving all three skills simultaneously.

Prior art golf swing practice devices try to keep the golfer's weight on the inside of the right foot, but ignore the role of the left foot in proper backswing and follow-through. Often such devices are cumbersome to use and force the golfer to assume awkward and unnatural positions while trying to develop proper balance during the swing. Generally, such devices fail to show the golfer what was done wrong during the backswing and follow-through, and fail to show proper foot position at the completion of the swing.

For example, Fern, U.S. Pat. No. 4,106,771 attempts to monitor angular position of the golfer's left foot during a swing by sounding an audible signal upon completion of the swing. Fern's apparatus, which is clamped to the golfer's shoe, is somewhat cumbersome to use and provides no information except at completion of the swing. 0'Brien, U.S. Pat. No. 3,363,903 is similarly cumbersome in attempting to keep the golfer's weight on the inside of the right foot during the backswing by providing a hitting station with an inclined adjustable block upon which the golfer places his inside foot. Hyotlaine, U.S. Pat. No. 3,638,950 provides a stance gauge that engages the toes of the golfer's shoes and includes an adjustable rod that contacts the golfer's leg to remind him of outside leg action during the swing. Spedding, U.S. Pat. No. 3,955,821 provides a foot plate for use on each shoe during practice.

Known putting practice devices frequently ignore the fact that one good putter may use considerable wrist action, another good putter may use considerable shoulder action, while a third good putter may use a combination of each. Devices such as Ford, U.S. Pat. No. 3,868,116, which compel the golfer to strike the ball within two adjustable parallel bars, tend to force all golfers to adopt whatever stroke the practice device was designed about. Berkey, U.S. Pat. No. 4,082,287 provides a cantilevered ledge under which the putting club head must travel, and thus compels the practicing golfer to practice only the stroke for which the Berkey apparatus was designed. Pelz, U.S. Pat. No. 4,437,669 provides a catenary-like putting practice track which keeps the putter club head between the track sides and is elevated at either end to facilitate stroking, thus providing a bit more flexibility than devices such as Ford and Berkey. Realistic putting practice requires that the golfer be readily able to aim the ball at different targets, such as compensating for breaks in the green. However known devices permit putting practice towards a single target only, and the golfer must bend over and lift or move the entire apparatus to re-aim at a different target.

What is needed is a single apparatus capable of providing practice to simultaneously perfect balance, alignment and stance during a golf swing, and capable of providing flexible putting practice. When used to practice swings, the apparatus should indicate to the golfer proper weight distribution during the backswing and follow-through, and proper weight transfer during follow-through after the ball has been struck. The apparatus should also provide alignment guidance and indicate proper foot position at the completion of the swing. When used to practice putting, the device should not constrain the golfer's putting style, and should be capable of re-aiming without the golfer having to bend over or lift or move a heavy apparatus. Finally, regardless of the practice it provides, the apparatus should be straightforward and inexpensive in its construction, and should not be cumbersome in use.

SUMMARY OF THE INVENTION

The present invention is an apparatus for practicing golf swings or putting. In contrast to known practice devices, the present invention permits improving balance, alignment and stance simultaneously while practicing swings, and also serves as a putting practice aid. During swing practice, the present invention provides tactile pressure on the golfer's feet during the backswing, downstroke and during a portion of the follow-through after striking the ball, to remind the golfer not to sway off his right foot. Further, if the golfer's stands at an angle with respect to the present invention, hook and slice swings, i.e., intentional curving of the ball to the left or right, maybe practiced. When used to practice putting, the present invention provides alignment between the ball and the target, and is readily aimable without the user having to bend over. The structure of the present invention is lightweight, inexpensive and the present invention is not cumbersome in use.

The present invention includes an elongate bar and a swivel mount and, in a preferred embodiment, a choice of end pieces that removably attach to an end of elongate bar. The elongate bar is pivotally mounted at a first bar end to the swivel mount, and the swivel mount is attached to the ground or other practice surface. The first end of the bar is maintained by the swivel mount a chosen distance above the ground or practice surface and, when practicing swings, the second end of the bar is maintained at a similar height. The swivel mount permits the bar to pivot upwards about a pivot axis adjacent the first end of the bar, and also permits the bar to swivel 360° about a swivel axis perpendicular to the ground adjacent the first end of the bar. The swivel mount includes a base plate and is attached to the ground, in a first embodiment, by driving golf tees through holes in the base plate and into the ground. In a second embodiment, the base plate is affixed to a C-shaped clamp which clamps the swivel mount to the edge of a practice surface. The bar may include calibration indicia to guide the golfer in setting the width of his feet while swinging, or for club placement during putting.

When practicing swings, the bar is aimed parallel to the target line, and the toes of the golfer's feet are placed beneath the elongate bar, permitting the bar to exert a tactile downward force upon the golfer's shoes. A discovery made by the present inventors is that during a proper backswing, the bar will remain upon both of the golfer's shoe toes only if a proper weight shift occurs, and will continue to rest upon the golfer's shoes until just prior to striking the ball. After striking the ball and during follow-through, if a proper stroke occurs, the golfer's right shoe (for a right-handed golfer) will cause the bar to pivot upwardly so the bar will no longer rest on the golfer's right shoe. Thus the bar provides alignment guidance during the swing, while the light but tactile force provided by the bar across the golfer's shoes provides guidance for practicing proper weight transfer during the swing.

When used to practice putting, the second end of the bar is maintained a somewhat greater distance above the ground than the first end. The bar is swiveled to aim at the target and the ball is placed on the putting surface beneath the bar. The bar helps the golfer to place his eyes properly over the ball, and also provides alignment guidance while striking the ball with a club. The bar does not unduly constrain the golfer's putting stroke, other than a low putting stroke is required, and if re-aiming is required, the bar is swivelled with the head of a golf club without requiring the golfer to bend over.

Although a heavy duty pivot mount could position and maintain the bar in cantilever fashion in the positions above described, in a preferred embodiment an end piece is removably attached to the second end of the bar to permit the use of an inexpensive, lightweight swivel mount. During swing practice, a swing end piece is attached to the second end of the bar and during putting practice, a putting end piece is attached to the second end of the bar. The swing end piece maintains the second end of the bar in the desired position (so the bar is generally horizontal) for swing practice, and the putting end piece maintains the second end of the bar in the desired position (so the bar is preferably upwardly inclined towards the second end) for putting practice.

The present invention advantageously provides a light-weight, inexpensive and non-encumbering apparatus for practicing golf swings and putting. The apparatus permits simultaneous improvement of a golfer's balance, alignment and stance, and provides information to the golfer during the backswing, downswing and follow through. Further, during practice the apparatus may be re-aimed without requiring the golfer to bend over.

Other features and advantages of the invention will appear from the following description wherein the preferred embodiment has been set forth in detail in conjunction with the accompanying drawings.

DETAILED DESCRIPTION OF THE PREFERRED EMBODIMENT

Figure 1A:
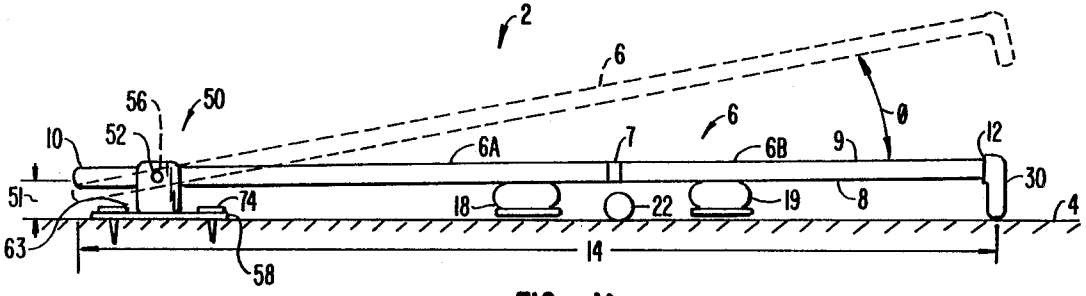
FIG. 1A is a side view of a preferred embodiment of an apparatus for practicing golf swings according to the present invention.
Figure 1B:
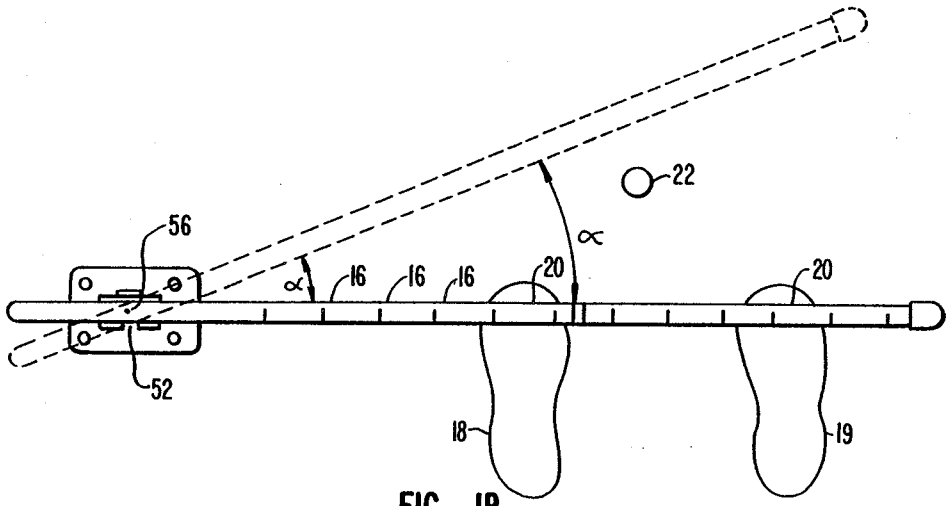
FIG. 1B is a top view of the apparatus shown in FIG. 1A.

FIG. 1A and FIG. 1B show a golf practice apparatus 2 according to the present invention, configured to practice golf swings, sitting atop a golf practice surface 4. Apparatus 2 includes an elongate member 6 that, for convenience sake, may be composed of two or more members **6*a* and 6*b* coupled together by a joining member 7. Elongate member 6 includes a lower surface 8, an upper surface 9, a first end 10, a second end 12 and a length 14 therebetween. Upper surface 9 may include calibration indicia 16 which the golfer may use for guidance in foot placement or for other purposes. FIG. IA and FIG. 1B shows that, when apparatus 2 is configured to swing practice, the golfer's stands with first end 10 to his left and places his left foot 18 and right foot 19 under elongate member 6, such that member 6 rests atop the toe portion 20 of each foot 18, 19. Ball 22 is placed generally in front of the golfer. Because the embodiment of FIG. 1A and FIG. 1B is configured for swing practice, a swing end piece 30 (i.e., the end piece to be used when practicing swings) is removably attached to second end 12. Swing end piece 30 is shown in greater detail in FIG. 1C. When configured to practice putting, apparatus 2 has a putting end piece 40 removably attached to second end 12** (see FIGS. 2A, 2B, 2C).

As shown in FIG. 1A and FIG. 1B, a pivot mount 50 attaches to member 6 proximate the first end 10 and permits member 6 to pivot upwardly, as shown in phantom, about a pivot axis 52. First end 10 attaches to pivot mount 50 such that the lower surface 8 of the elongate member 6 is a first distance 51 above the ground or practice surface 4. Pivot mount 50, as shown in greater detail in FIG. 3A, includes swivel mechanism 63 which permits elongate member 6 to swivel 360° about a vertical swivel axis 56 adjacent end 10 of member 6. It is to be understood that the swivel angle $\alpha$ shown in FIG. 1B may vary from 0°–360° about axis 56.

Figure 1C:
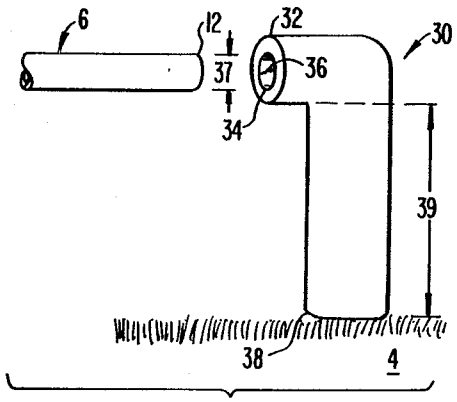
FIG. 1C is a perspective view of the swing end piece shown in FIG. 1A and FIG. 1B.

With reference to FIG. 1C, the swing end piece 30 is shown as having an inverted-L shape with a first face 32 that includes an opening 34 whose shape and transverse dimension 36 are sized to frictionally accommodate and retain second end 12 of member 6, which second end 12 has a transverse dimension 37. End piece 30 has a second face 38 that is allowed to rest upon the ground or practice surface 4. End piece 30 has a length 39. As noted, end piece 30 (and end piece 40 as well) may be dispensed with entirely if pivot mount 50 is made sufficiently heavy duty to maintain elongate member 6 in the desired position in cantilever fashion. However in keeping with the objective of producing an inexpensive, lightweight and non-cumbersome apparatus, the preferred embodiments utilize end pieces 30 and 40.

In the preferred embodiment of FIG. 1A, elongate member 6 has length 14 approximately 36" (1 m), transverse dimension 37 about 0.5" (1.2 cm) and is PCV plastic pipe, although wood, metal or other material could also be used. The first end 10 is mounted in pivot mount 50 such that the first distance 51 is about 2.5" (6.2 cm). In that embodiment, swing end piece 30 is elbow-joint PCV having length 39 about 2.5" (6.2 cm) and bore 36 of about 0.5" (1.2 cm) diameter. End piece 30 slips on to end 12 and is frictionally maintained on elongate member 6. Since first distance 51 and length 39 are substantially equal, elongate member 6 is maintained substantially parallel to the ground or practice surface 4. During swing practice, elongate member 6 rests atop the toe portions 20 of the golfer's feet 18 and 19, as shown in FIG. 1A.

Figure 2A:
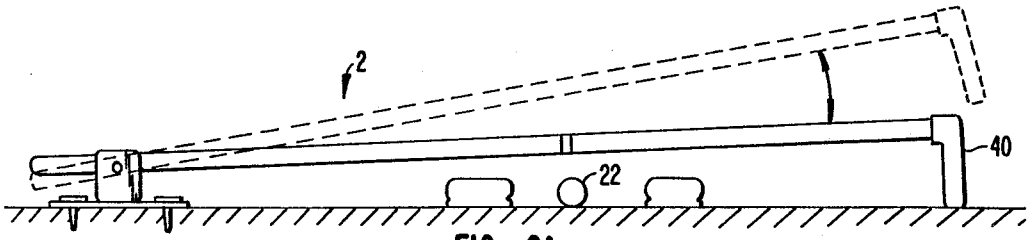
FIG. 2A is a side view of a preferred embodiment of an apparatus for practicing putting according to the present invention.
Figure 2B:
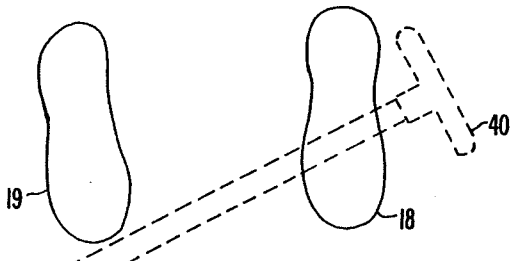
FIG. 2B is a top view of the apparatus shown in FIG. 2A.
Figure 2B:
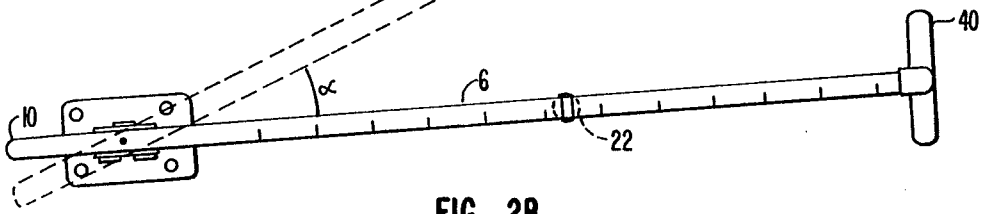
Figure 2C:
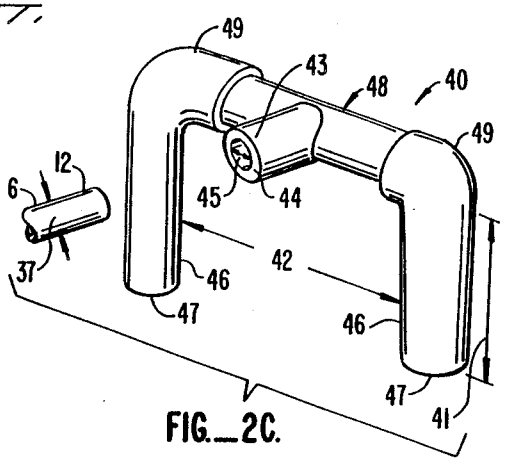
FIG. 2C is a perspective view of the putting end piece shown in FIG. 2A and FIG. 2B.
Figure 6:
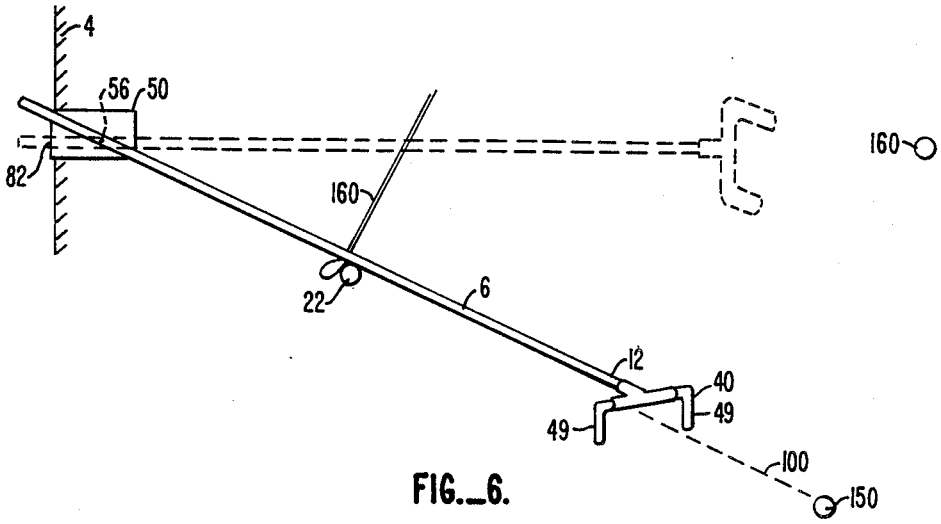
FIG. 6 is a perspective view of the apparatus of FIG. 2A with the swivel mount shown in FIG. 3B is use for putting practice.

FIG. 2A and FIG. 6 show an apparatus 2 identical to the apparatus shown in FIG. 1A and 1B except that the swing end piece 30 has been replaced with a putting end piece 40. Note that in FIG. 2A and FIG. 2B, the golfer's stands with the first end 10 to his right, his feet 18, 19 behind elongate member 6, and with the ball 22 placed directly under member 6, at about mid-length. Putting end piece 40 is shown in FIG. 2C as having an inverted-U shape with height 41, width 42, and including a face 43 defining an opening 44 whose shape and transverse dimension 45 accommodate the transverse dimension 37 of end 12 of elongate member 6. In use, end piece 48 is removably attached to end 12 of elongate member 6 by forcing end 12 into the opening 44 in face 43. End piece 40 includes leg members 46 having faces 47 which rest upon the ground or other practice surface 4.

In the preferred embodiment shown in FIG. 2C, putting end piece 40 is a T-section 48 of CPVC plastic pipe permanently joined, as with glue, with two elbow-joint sections 49 of CPVC plastic pipe. Height 41 and width 42 are each about 4.5" (11.4 cm). A width 42 of 4.5" (11.4 cm) approximates the width of a hole in a putting green, while a height 41 of 4.5" (11.4 cm) provides an adequate clearance for a putting golf club head while using device 2. With reference to FIG. 2C, bore 45 is about 0.5" (1.2 cm) diameter, which dimension accommodates transverse dimension 37 of end 12.

Figure 3A:
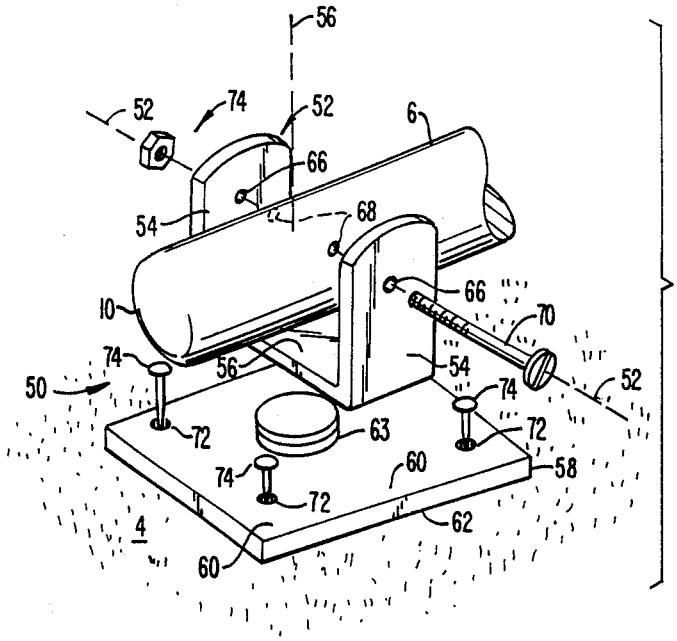
FIG. 3A is a perspective exploded view of a first embodiment of a swivel mount according to the present invention.
Figure 3B:
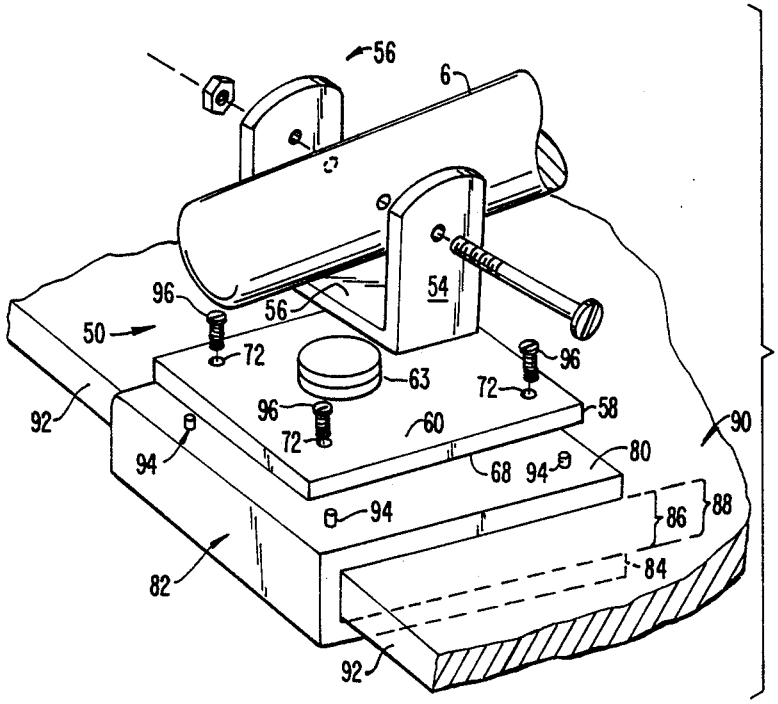
FIG. 3B is a perspective exploded view of a second embodiment of a swivel mount according to the present invention.

FIG. 3A and FIG. 3B show two embodiments of pivot mount 50 for use respectively on the ground 4 or on a practice mat 90. Either embodiment of pivot mount 50 may be used regardless of whether apparatus 2 is configured for practicing swings or for practicing putting. However, the embodiment of FIG. 3A is best suited for putting practice on grass, or rugs, or the like.

The first embodiment of pivot mount 50 is shown in FIG. 3A as including a U-shaped channel 52 member having parallel vertical side walls 54 and a bottom wall 56. Pivot mount 50 further includes a base plate 58 having an upper surface 60 and a lower surface 62, and swivel mechanism 63 for attaching the bottom wall 56 of U-shaped channel 52 to the upper surface 60 of the base plate 58. Swivel mechanism 63 is known in the art and will not be described further except to say that swivel mechanism 63 defines a swivel axis 56 adjacent first end 10, about which axis member 6 is free to rotate 360°.

Sidewalls 54 include holes 66 which align with similar holes 68 in elongate member 6 to provide for pivotally attaching member 6 to pivot mount 50. In a preferred embodiment, a screw 70 passes through holes 66 and 68 to pivotally attach member 6 to pivot mount 50. Screw 70 is secured by a washer and nut assembly 74. The longitudinal axis of screw 70 defines the pivot axis 52 about which member 6 is free to move upward through an angle $\phi$ as shown in FIG. 1.

A swivel mount 50 according to FIG. 3A includes a number of holes 72 through base plate 58. A golf tee 74 is driven through each hole 72 to secure the swivel mount 50, and thus apparatus 2, into the ground or other practice surface 4 upon which swivel mount 50 sits.

An alternate embodiment of a swivel mount 50 is shown in FIG. 3B wherein the lower surface 62 of base plate 58 is affixed to an upper surface 80 of a C-shaped member 82. C-shaped member 82 includes an upper surface 80 and lower surface 84 which are separated by a distance 86 that approximates the thickness 88 of mats 90 used at some golf practice facilities. C-shaped member 82 is made of flexible material such as metal to accommodate slightly varying thicknesses 88. In use, C-shaped member 82 clamps onto an edge 92 of a practice mat 90. Upper surface 80 may include tapped holes 94 which coincide with holes 72 in base plate 58 for receiving screws 96 for removably attaching plate 58 to C-shaped clamp 82. By removably attaching plate 58 to clamp 82, swivel mount 50 may readily be converted from use on the ground 4 (the embodiment of FIG. 3A) to use on a practice mat 90 (the embodiment of FIG. 3B).

Figure 4A:
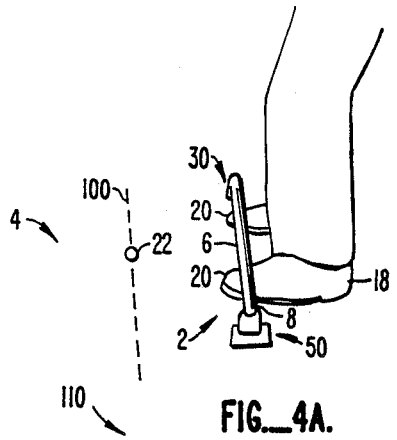
FIG. 4A and FIG. 4B are perspective views of the apparatus of FIG. 1A and FIG. 1B, in use during a backswing.
Figure 4D:
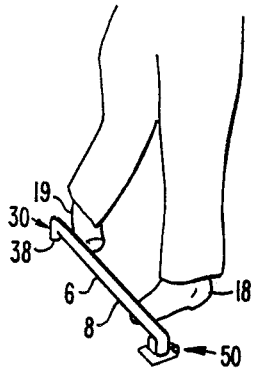
FIG. 4D and FIG. 4E are perspective views of the apparatus of FIG. 1A and FIG. 1B, in use showing follow through after striking the ball.
Figure 4B:
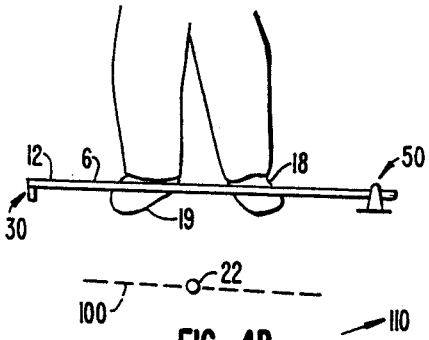

FIGS. 4A–4E show the preferred invention, configured for swing practice, with swing end piece 30 attached to second end 12 of elongate member 6. Face 38 of end piece 30 simply rests atop surface 4 with the result that member 6 is disposed substantially parallel to and about 2.5" (6.2 cm) above surface 4. The golfer then aligns member 6 parallel to an imaginary target line 100 drawn between the ball 22 and the intended target 110 (not shown to scale). While practicing swings, the golfer's stands with the swivel mount 50 to his left, with the toe portion 20 of his left and right feet 18, 19 beneath and in contact with member 6. FIG. 4A and FIG. 4B show a golfer during a backswing. As shown therein, ball 22 is placed in front of the golfer on the side of member 6 opposite from the golfer. (A right handed male golfer is assumed, although the present invention works with right or left handed golfers of either sex).

Because member 6 is parallel to the target line 100, member 6 acts an alignment aide, causing the golfer's feet, knees, hips and shoulders to line up on the bar, parallel to the target line. The approximate 2.5" (6.2 cm) height of member 6 above surface 4 causes the underside 8 of member 6 to rest atop the toe portion 20 of the golfer's left and right shoes 18, 19, exerting a tactile downward force on the shoes. Once his feet are in place beneath member 6, the golfer's wings his golf club, striking the ball 22 in the usual manner.

Figure 4C:
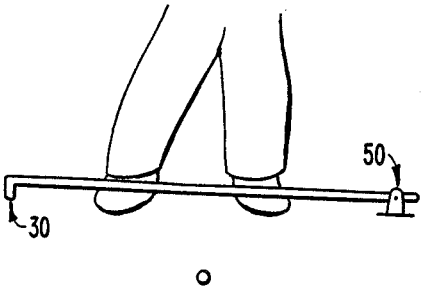
FIG. 4C is a perspective view of the apparatus of FIG. 1A and FIG. 1B, in use during the first portion of a downswing.
Figure 4E:
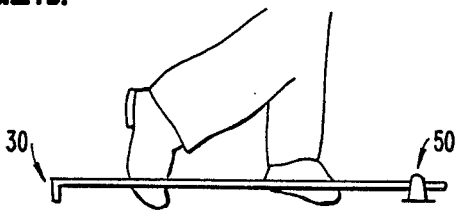

FIG. 4C shows the present invention during the initial portion of the down stroke, while FIG. 4D and FIG. 4E show the present invention during follow through, after the ball has been struck.

According to the discovery of the inventors, if the golfer's backswing and at least the first portion of the downstroke is performed with a proper weight transfer, the elongate member 6 Will remain in position as shown in FIGS. 4A–4C, i.e., atop the golfer's shoes 18, 19. While, for example, FIG. 4C shows the left foot 18 as having moved to reflect a weight shift, at the completion of the backswing member 6 still rests atop shoes 18, 19 where it will remain until at least an early portion of the downward stroke. As shown by FIG. 4D and FIG. 4E, during the downward stroke and continuing through the follow-through, the right foot 19 properly moves, causing member 6 to no longer rest across the tops of both shoes 18, 19.

In short, the golfer uses the light but tactile force provided by member 6 across the shoe tips 20 to practice his swing. During the backswing, if member 6 comes off the left shoe first, the golfer knows that the left foot moved forward improperly. If during the backswing member 6 comes off the right shoe or pivots up off both shoes, an improper forward weight shift, or an improper weight transfer to the outside of the right foot is indicated. The golfer then knows to practice his backswing until member 6 remains atop the shoes, exerting a tactile downward force, during the entire backswing, thus indicating proper weight shift. During the downswing, member 6 should remain atop both shoes until shortly before the ball is struck with the golf club. If member 6 pivots upwardly during the downswing, the golfer knows that he has prematurely shifted his left knee forward. After striking the ball, proper balance and weight shift occur if member 6 is completely off the right foot or off both feet.

Figure 5A:
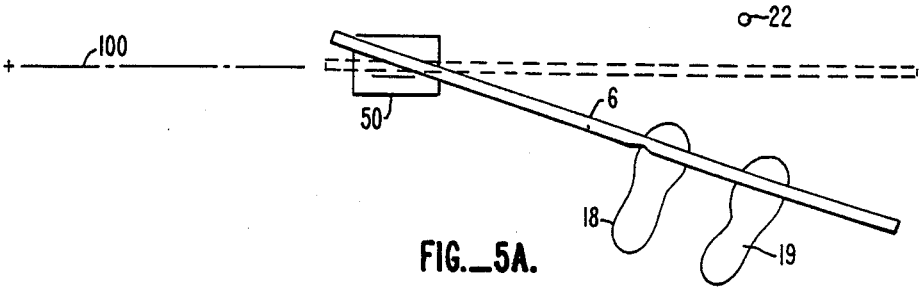
FIG. 5A is a perspective view of the apparatus of FIG. 1A and FIG. 1B, in use practicing a hook swing.
Figure 5B:
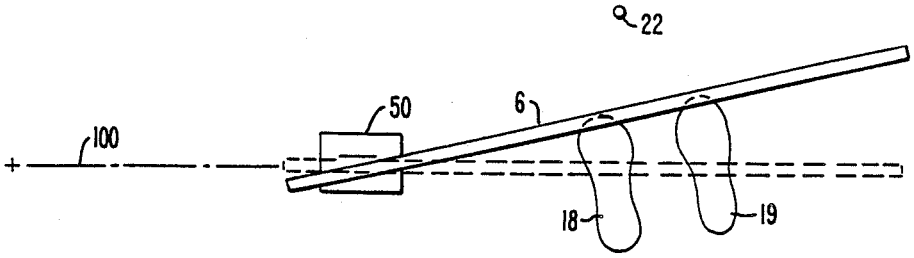
FIG. 5B is a perspective view of the apparatus of FIG. 1A and FIG. 1B, in use practicing a slice swing.

Because member 6 and the golfer's feet were set parallel to the target line 100, the golfer is able to simultaneously check proper alignment and balance throughout his swing. However, as shown by FIG. 5A and FIG. 5B, by intentionally aligning the bar and feet at an angle to the target line, the golfer may practice hooks (also known as draws) or slices (fades). FIG. 5A shows how member 6 is aligned off the target line 100 to practice hooks, whereas as shown in FIG. 5B, member 6 is aligned off the target line 100 in the opposite sense to practice slices.

FIG. 6 shows an embodiment of the invention shown in FIG. 2A in perspective. As noted, when used to practice putting, the putting end piece 40 is attached to second end 12 of member 6. In use, ball 22 is placed beneath member 6, about mid-length, where member 6 is aligned on an imaginary target line 100 extending from ball 22 to target 150. Member 6 is aligned simply by swivelling member 6 about the vertical swivel axis 56, preferably using a golf club which eliminates the need to bend over to align member 6. FIG. 6 shows member 6 as having been swivelled to align with target 150 as opposed to target 160.

Good putting technique requires that a golfer's eyes look straight down upon the ball 22 or on the inside of the ball (i.e., the portion of ball 22 nearest the golfer), but never on the outside. The present invention permits the golfer to place his eyes either directly over or inside the ball, as preferred, using member 6 to maintain the proper eye position and to ensure that the eyes are never located outside the ball. The golfer then uses a putter 160 to strike the ball, causing the ball to pass through members 49 of putting end piece 40, and travel along the target line 100 towards the target 150. The height of member 6 forces the golfer to use a low putting stroke.

Modifications and variations can be made to the disclosed embodiment without departing from the subject of the invention as defined in the following claims. For example, plate 58 could be made of heavy metal whose weight would be sufficient to maintain pivot mount 50 and elongate member 6 in position without need for other mounting structures such as tees 74 or clamps 82.

What is claimed is:

1. A golf practice apparatus for practicing swings or for practicing putting on a practice surface, comprising:

an elongate bar member having first and second ends and a length therebetween; and a pivot mount, pivotally attached to the elongate bar member adjacent the first end, for pivotally holding the first end a first distance above the practice surface;

means for supporting the second end of the elongate bar member at a plurality of chosen distances above the practice surface, a first of the chosen distances being substantially equal to the first distance:

said first distance and a first of the chosen distances being selected to cause a lower surface of the elongate bar member to make tactile contact with and exert a downward force upon an upper toe portion of a golfer's left and right shoes during proper backswing and downstroke portions of a practice swing:

said downward force providing tactile information to the golfer that the backswing and downstroke were proper;

the pivot member permitting the elongate bar member to pivot off the golfer's right shoe upon striking the ball, and during subsequent follow-through:

a second of the chosen distances being greater than the first distance to maintain the elongate bar member a sufficient distance above the practice surface to permit a low putting stroke:

the elongate bar member being maintained by the pivot mount and the means for supporting in alignment with a putting target, the elongate bar member providing thereby an alignment aid for proper putting practice.

2. The apparatus of claim 1, wherein the pivot mount includes means for swiveling the elongate bar member about a vertical axis adjacent the first end.

3. The apparatus of claim 1, wherein the elongate bar member includes calibration indicia.

4. The apparatus of claim 1, further including a base plate for mounting the pivot mount to the practice surface, the base plate defining a hole sized to accept a golf tee;

the apparatus being mounted by driving a golf tee through the hole into the practice surface.

5. The apparatus of claim 1, further including a base plate and a C-shaped clamp, attached together, for clamping the pivot mount to an edge of a mat practice surface.

6. The apparatus of claim 1, wherein the length of the elongate bar member is between about 25" (62.5 cm) and about 45" (114 cm).

7. The apparatus of claim 1, wherein the first chosen distance is about 2.5" (6.2 cm).

8. The apparatus of claim 1, wherein the second chosen distance is about 4.5" (11.4 cm).

9. The apparatus of claim 1, wherein the elongate bar member is plastic pipe.

10. A golf practice apparatus for practicing swings or for practicing putting on a practice surface, comprising:

an elongate bar member having first and second ends and a length therebetween:

a pivot mount, pivotally attached to the elongate bar member adjacent the first end, for pivotally holding the first and a first distance above the practice surface; and an end piece having a height, removably attached to the second end of the elongate bar member;

the height of the end piece being substantially the same as the first distance when the apparatus is used for practicing swings, and the height and the end piece being about twice the first distance when the apparatus is used for practicing putting;

the height of the end piece used for practicing swings being made approximately equal to the first distance, such that when practicing swings, the pivot mount and end piece maintain a lower surface of the elongate bar member in tactile contact with and exerting a downward force upon an upper toe portion of a golfer's left and right shoes during a proper backswing and proper downstroke;

said downward force providing tactile information to the golfer that the backswing and downstroke were proper;

the pivot member permitting the elongate bar member to pivot off the golfer's right shoe upon striking the ball, and during subsequent follow-through;

the height of the end piece used for practicing putting being made somewhat greater than the first distance, such that when practicing putting, the pivot mount and end piece maintain the elongate bar member a sufficient distance above the practice surface to permit a low putting stroke;

the elongate bar member being maintained by the pivot mount in alignment with a putting target, the elongate bar member providing thereby an alignment aid for proper putting practice.

11. The apparatus of claim 10, wherein the end piece used for practicing putting defines an inverted-U shape having said height, and a width through which the ball is putted.

12. The apparatus of claim 11, wherein said height of the inverted-U shaped end piece is about 4.5" (11.4 cm).

13. The apparatus of claim 11, wherein the width of the inverted-U shaped end piece is about 4.5" (11.4 cm).

14. The apparatus of claim 10, wherein the pivot mount includes means for swiveling the elongate bar member about a vertical axis adjacent the first end of the elongate

15. The apparatus of claim 10, wherein the first distance is about 2.5" (6.2 cm).

16. The apparatus of claim 10, wherein the length of the elongate bar member is between about 25" (62.5 cm) and about 45" (114 cm).

17. The apparatus of claim 10, wherein the elongate bar member includes calibration indicia.

18. The apparatus of claim 10, further including a base plate for mounting the pivot mount to the practice surface, the base plate defining a hole sized to accept a the apparatus being mounted by driving a golf tee through the hole into the practice surface.

19. The apparatus of claim 10, further including a base plate and a C-shaped clamp, attached together, for clamping the pivot mount to an edge of a mat practice surface.

20. The apparatus of claim 10, wherein the pivot mount includes means for swiveling the elongate bar member about a vertical axis adjacent the first end of the elongate bar member.

21. The apparatus of claim 10, wherein the elongate bar member and each end piece are plastic pipe.

22. A method for improving a golfer's swing on a practice surface, comprising the following steps:

aligning the golfer's two feet on a target line parallel to an intended target:

exerting on a toe portion of each of the golfer's during approximately the first half of a proper downswing;

removing the tactile force from at least one of the golfer's feet only upon properly striking the ball and during a subsequent proper follow-through;

the presence of the tactile force confirming to backswing, downswing, and the removal of the golfer a proper the tactile force from at least one of the golfer's feet upon striking the ball and during follow through confirming to the golfer the proper weight transfer during the backswing and downswing.

23. A method for improving a golfer's curved swing on a practice surface, comprising the following steps:

aligning the golfer's two feet on a target line not parallel to an intended target;

the target line passing to a right side of the intended target for practicing hooks:

the target line passing to a left side of the intended target for practicing slices:

exerting on a toe portion of each of the golfer's feet a tactile force only during a proper backswing and during approximately the first half of a proper downswing:

removing the tactile force from at least one of the golfer's feet only upon properly striking the ball and during a subsequent proper follow-through:

the presence of the tactile force confirming to the golfer a proper backswing, downswing, and the removal of the tactile force from at least one of the golfer's feet upon striking the ball and during follow through confirming to the golfer the proper weight transfer during the backswing and downswing.

* * * * *